US006017202A

United States Patent [19]

Durnack et al.

[11] Patent Number: 6,017,202

[45] Date of Patent: Jan. 25, 2000

[54] BI-DIRECTIONAL GEROTOR-TYPE FLUID PUMP

[75] Inventors: Michael J. Durnack, Baldwinsville; Timothy M. Burns, Rochester, both of N.Y.

[73] Assignee: New Venture Gear, Inc., Troy, Mich.

[21] Appl. No.: 08/989,038

[22] Filed: Dec. 11, 1997

[51] Int. Cl.[7] ..... F16C 21/16

[52] U.S. Cl. ..... 418/32; 418/166; 418/171

[58] Field of Search ..... 418/32, 166, 171

[56] References Cited

U.S. PATENT DOCUMENTS

| | | | |
|---|---|---|---|
| 3,741,693 | 6/1973 | Stockton | 418/32 X |
| 4,193,746 | 3/1980 | Aman, Jr. | 418/32 |
| 4,247,267 | 1/1981 | Lindtveit | 418/32 |
| 4,392,796 | 7/1983 | Lindtveit | 418/32 |
| 4,420,292 | 12/1983 | Lutz | 418/32 |
| 5,711,408 | 1/1998 | Dick . | |

*Primary Examiner*—Hoang Nguyen

*Attorney, Agent, or Firm*—Harness, Dickey & Pierce, P.L.C.

[57] ABSTRACT

A bi-directional fluid pump for providing a source of pressurized fluid. The fluid pump includes a gerotor assembly, an inlet valve system, and an outlet valve system which work cooperatively to provide pressurized fluid during two directions of rotation.

16 Claims, 5 Drawing Sheets

BI-DIRECTIONAL GEROTOR-TYPE FLUID PUMP

BACKGROUND OF THE INVENTION

The present invention relates generally to fluid pumps and, more particularly, to a bidirectional gerotor pump.

As is conventional, gerotor pumps are used in power transfer units of the type installed in motor vehicles for supplying lubrication to the rotary driven components. Such power transfer units include manual and automatic transmissions, transaxles, and four-wheel drive transfer cases. Typically, the gerotor pump has a stationary outer ring defining a pumping chamber and an inner ring positioned in the pumping chamber and which is fixed for rotation with a driven member (i.e., a shaft, etc.). The inner ring has external lobes which are meshed with and eccentrically offset from internal lobes formed on the outer ring. Since the number of internal lobes is greater than the number of external lobes, driven rotation of the inner ring results in a pumping action wherein a supply of hydraulic fluid is drawn from a sump in the power transfer unit into the suction side of the pumping chamber and is discharged from the pressure side of the pumping chamber at an increased pressure.

A drawback associated with conventional gerotor pumps is that the pumping action is only generated in response to rotation of the inner ring in one direction. As such, gerotor pumps are arranged in most power transfer units to generate the pumping action during rotation of the inner ring in a direction corresponding to forward driven operation of the motor vehicle. Since the gerotor pump does not generate a supply of hydraulic fluid when the inner ring is driven in the opposite direction, an undesirable condition may result wherein an inadequate supply of lubrication is delivered to the rotary components during extended periods of reverse operation. To alleviate this condition, some power transfer units are equipped with a first pump for lubricant supply in forward operation and a second pump for lubricant supply in reverse operation. As is obvious, the addition of a second pump adds both cost and weight to the power transfer unit. Thus, a continuing need exists to develop alternatives to conventional uni-directional gerotor pumps for use in power transfer units.

SUMMARY OF THE INVENTION

It is therefore an object of the present invention to provide a rotary-driven fluid pump capable of transporting fluid from a pump inlet to a common pump outlet when driven in both rotational directions.

As a further object of the present invention, the bi-directional fluid pump includes a gerotor assembly, an inlet valve system controlling fluid flow between the pump inlet and a pumping chamber, and an outlet valve system controlling fluid flow between the pumping chamber and the pump.

According to the preferred embodiment, the fluid pump includes a pump housing defining a pump inlet adapted to receive fluid from a fluid source, first and second inlet chambers, an outlet chamber having a pump outlet, a first flow path in fluid communication with the first inlet chamber and the outlet chamber, a second flow path in fluid communication with the second inlet chamber and the outlet chamber, and a pump chamber in fluid communication with the first and second flow paths. The fluid pump further includes a gerotor assembly comprised of a stator ring supported for rotation in the pump chamber and having an aperture defining a series of internal lobes, and a pump ring supported for rotation in the aperture of the stator ring and having an outer peripheral surface defining a series of external lobes. In addition, the fluid pump includes a first inlet valve retained in the first inlet chamber for movement between a first position preventing fluid communication between the pump inlet and first inlet chamber and a second position permitting fluid communication therebetween, a second inlet valve retained in the second inlet chamber for movement between a first position preventing fluid communication between the pump inlet and second inlet chamber and a second position permitting fluid communication therebetween, and an outlet valve retained in the outlet chamber for movement between a first position and a second position. The outlet valve is operable in its first position to prevent fluid communication between the first flow path and the outlet chamber while permitting fluid communication between the second flow path and the outlet chamber. The outlet valve is operable in its second position to prevent fluid communication between the second flow path and the outlet chamber while permitting fluid communication between the first flow path and the outlet chamber. In operation, rotation of the gerotor assembly in a first direction relative to the pump housing generates a pumping action between the pump ring and the stator ring for drawing fluid into the pump inlet and causing the first inlet valve to move to its second position, the second inlet valve to move to its first position, and the outlet valve to move to its first position. In contrast, rotation of the gerotor assembly in a second direction relative to the pump housing generates a pumping action between the pump ring and the stator ring for drawing fluid into the pump inlet and causing the second inlet valve to move its second position, the first inlet valve to move its first position, and the outlet valve to move to its second position. As such, a pumping action is generated for supplying fluid to the pump outlet regardless of which rotary direction the gerotor assembly is driven.

BRIEF DESCRIPTION OF THE DRAWINGS

Further objects, features and advantages of the present invention will be readily apparent from the following detailed specification and the appended claims which, in conjunction with the drawings, set forth the best mode now contemplated for carrying out the invention. Referring to the drawings:

DETAILED DESCRIPTION OF THE PREFERRED EMBODIMENTS

Figure 1:
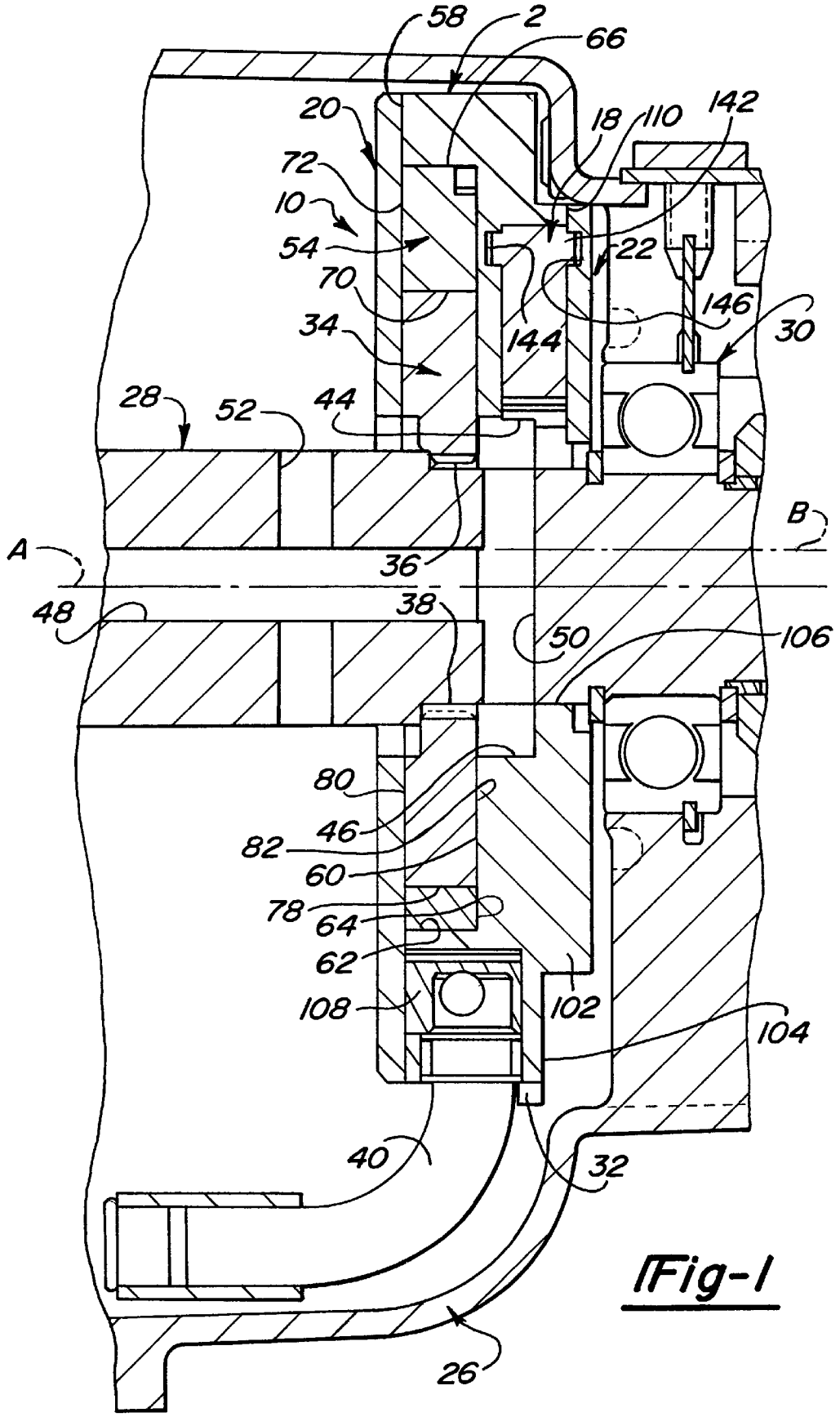
FIG. 1 is a partial sectional view showing a bi-directional fluid pump installed in an exemplary power transfer unit.
Figure 2:
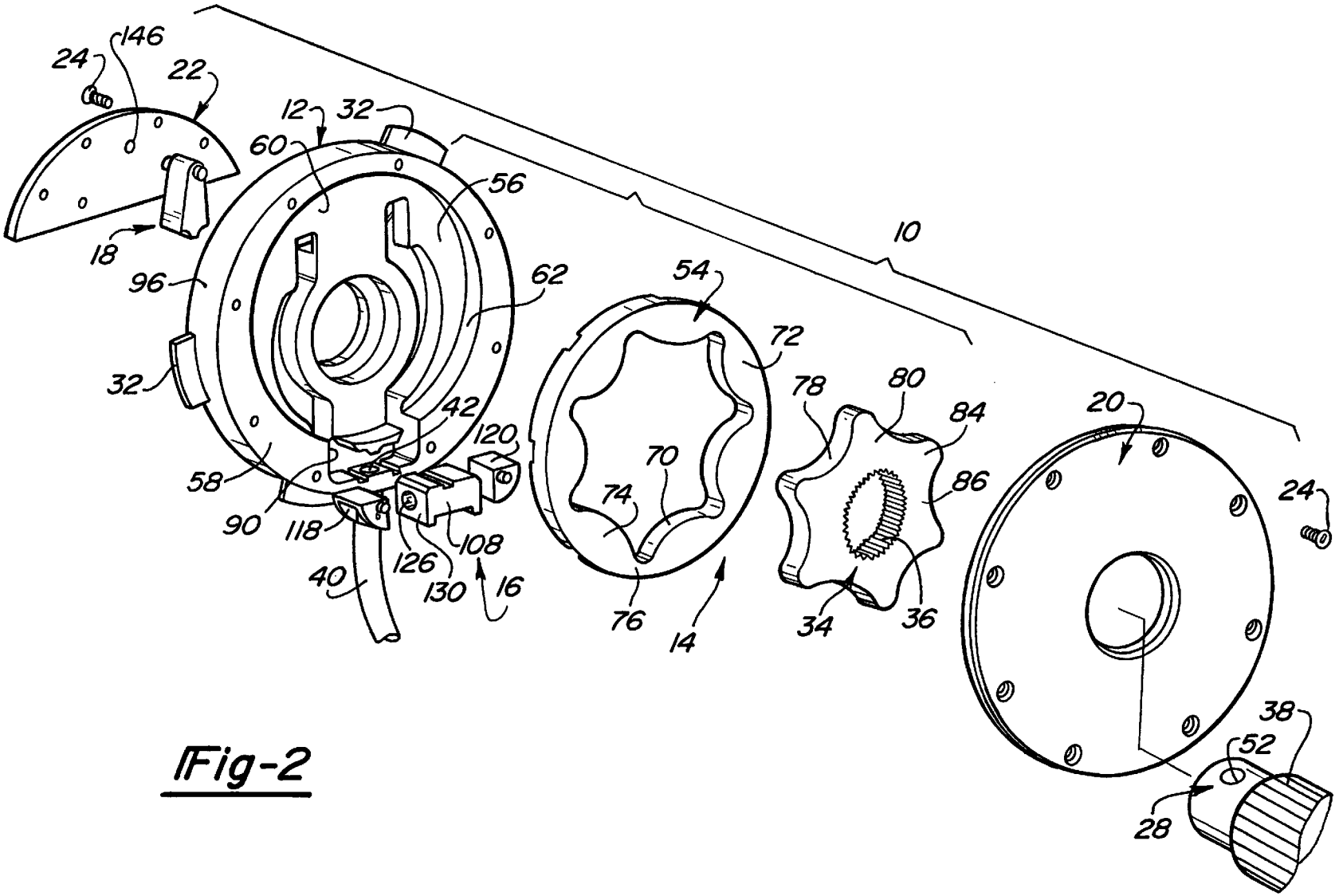
FIG. 2 is an exploded perspective view of the bi-directional fluid pump according to the present invention.

With particular reference now to FIGS. 1 and 2, the components of a fluid pump, hereinafter gerotor pump 10, are shown. In general, gerotor pump 10 is a bi-directional rotary-driven fluid pump which is contemplated for use in any pump applications requiring a supply of fluid to be delivered to a single pump outlet regardless of the direction of rotation. In general, gerotor pump 10 includes a pump housing 12, a gerotor assembly 14, an inlet valve assembly 16, and an outlet valve 18. Gerotor pump 10 is a self-contained unit and includes a front cover plate 20 and a rear cover plate 22, both of which are adapted to be secured to corresponding portions of pump housing 12 via suitable fasteners, such as screws 24. As such, gerotor pump 10 can be pre-assembled prior to installation into a suitable device with pump housing 12 held stationary and one component of gerotor assembly 14 secured for rotation with a driven member. In the embodiment shown, gerotor pump 10 is installed within a power transfer unit having a case 26 and a shaft 28 rotatably supported in case 26 via a bearing assembly 30 for rotation about a rotary axis "A". To provide means for non-rotatably fixing pump housing 12 to case 26, pump housing 12 is formed with a series of radially-extending tabs 32 which are adapted for receipt in complementary keyways (not shown) formed in case 26. In addition, a pump ring 34 of gerotor assembly 14 has a central aperture with internal splines 36 adapted for meshed engagement with external splines 38 formed on shaft 28 such that pump ring 34 is supported for rotation about the rotary axis "A".

As will be detailed, rotation of shaft 28 in either direction causes rotation of pump ring 34 for drawing hydraulic fluid from a sump area within case 26 through an inlet tube 40 and into a pump inlet port 42 formed in pump housing 12. Based on the direction of shaft rotation, inlet valve assembly 16 and outlet valve 18 control the flow of hydraulic fluid from inlet port 42 to a pump outlet port 44 through one of two flow paths. Fluid discharged from outlet port 44 is delivered to a discharge chamber 46 which supplies fluid to a central lubrication passage 48 formed in shaft 28 via a radial supply bore 50. Central lubrication passage 48 communicates with various rotary elements (not shown) such as, for example, bearings and/or speed gears which are rotatably supported on shaft 28 via a series of radial lubrication bores 52 also formed in shaft 28.

In addition to pump ring 34, gerotor assembly 14 includes a stator ring 54 which is rotatably supported in a pump chamber 56 formed in pump housing 12. Pump chamber 56 is circular and extends inwardly from a front face surface 58 of pump housing 12. Pump chamber 56 is defined by a planar pump surface 60 which is parallel to face surface 58 and a circumferential side wall 62 extending transversely with respect to pump surface 60. Additionally, the origin of circular pump chamber 56 is offset from the rotary axis "A" of shaft 28 and is shown by construction line "B" in FIG. 1. Thus, stator ring 54 is retained in pump chamber 56 such that its rear surface 64 slidingly engages pump surface 60 while its peripheral edge surface 66 slidingly engages side wall 62.

Figure 3:
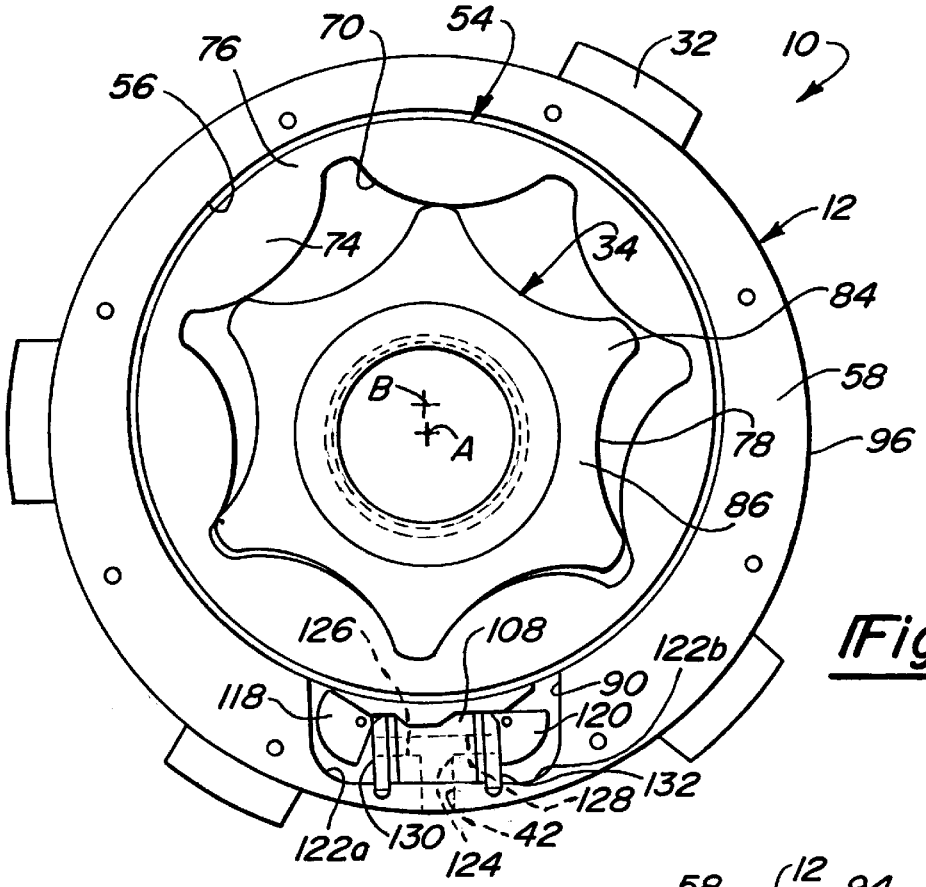
FIG. 3 is a front view showing the inlet valve assembly and gerotor assembly installed in the pump housing.

Stator ring 54 includes a generally sinusoidal aperture defined by an inner peripheral surface 70 formed between its front surface 72 and its rear surface 64 which defines a series of internal lobes 74 interconnected by a series of root segments 76. In contrast, pump ring 34 has an outer peripheral surface 78 between its front surface 80 and rear surface 82 which defines a series of external lobes 84 interconnected by a series of web segments 86. In the embodiment shown, stator ring 54 has seven lobes 74 while pump ring 34 has six lobes 84. Alternative numbers of lobes 74 and 84 can be used to vary the pumping capacity as long as the number of internal lobes 74 is one greater than the number of external lobes 84. Referring to FIG. 3, pump ring 34 is shown with its outer peripheral surface 78 engaged with various points along inner peripheral surface 70 of stator ring 54 to define a series of pressure chambers therebetween. Upon rotation of pump ring 34 about axis "A", stator ring 54 is caused to rotate in pump chamber 56 about axis "B" at a reduced speed relative to the rotary speed of pump ring 34 which causes a progressive reduction in the size of the pressure chambers therebetween for generating a pumping action wherein fluid is drawn from inlet port 42 at inlet pressure into a pressure chamber and ultimately discharged therefrom into outlet port 44 at a higher outlet pressure.

Figure 4:
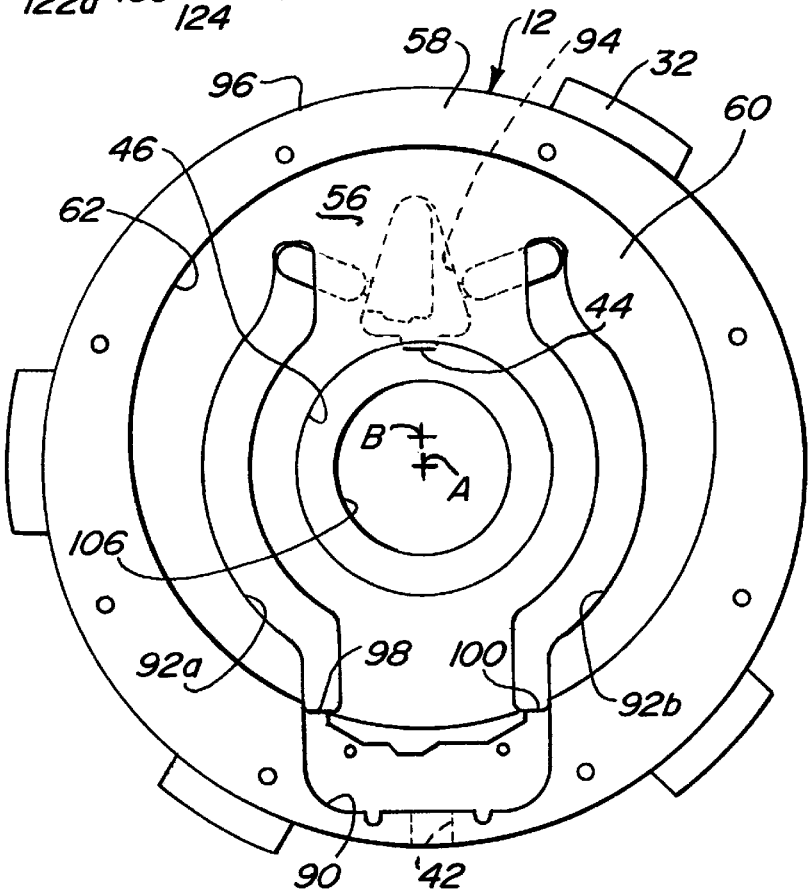
FIG. 4 is a front view, similar to FIG. 3, but showing the pump housing with the inlet valve assembly and the gerotor assembly removed.
Figure 6:
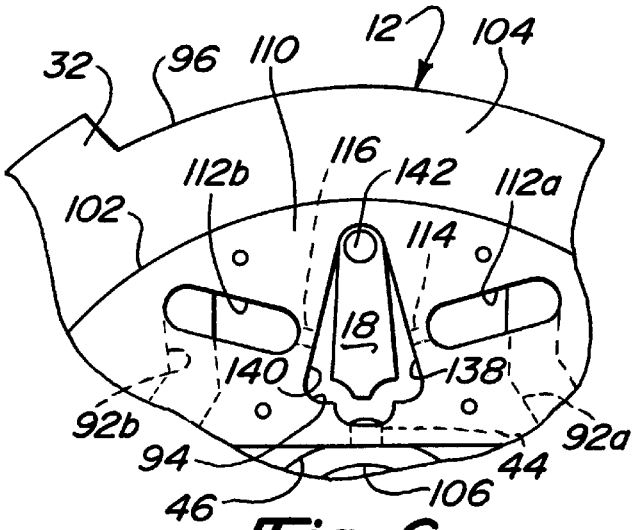
FIG. 6 is a partial rear view of the pump housing showing the outlet valve installed therein.

Pump housing 12 is also shown in FIGS. 4 and 6 to define an inlet chamber 90, a pair of symmetrical slots 92*a* and 92*b*, and an outlet chamber 94. In particular, inlet chamber 90 is in fluid communication with inlet port 42 and is formed between side wall 62 of pump chamber 56 and an outer peripheral surface 96 of pump housing 12. An aperture 98 provides a fluid communication path from one end of inlet chamber 90 to pump chamber 56 and a first end of slot 92*a*. Likewise, an aperture 100 provides a fluid communication path from the opposite end of inlet chamber 90 to pump chamber 56 and a first end of slot 92*b*. A circular hub segment 102 of pump housing 12 extends axially from its rear face surface 104 and defines a central aperture 106 through which a non-splined portion of shaft 28 extends. Hub segment 102 includes a recessed face surface 110 against which rear cover plate 22 is secured. Outlet chamber 94 extends inwardly from face surface 110 of hub segment 102 and communicates with discharge chamber 46 via outlet port 44. In addition, a second pair of symmetrical slots 112*a* and 112*b* extend inwardly from face surface 110 of hub segment 102. A first end of slot 112*a* communicates with a second end of slot 92*a* while an aperture 114 formed in a second end of slot 112*a* communicates with outlet chamber 94. Likewise, a first end of slot 112*b* communicates with a second end of slot 92*b* while an aperture 116 formed in a second end of slot 112*b* communicates with outlet chamber 94.

To control the flow of fluid from inlet chamber 90 into slots 92*a* and 92*b*, inlet valve assembly 16 is shown to include a valve stop 108, a first inlet valve 118, and a second inlet valve 120. Valve stop 108 is retained in inlet chamber 90 and bifurcates inlet chamber 90 to define a pair of inlet valve chambers 122*a* and 122*b*. Valve stop 108 has a T-shaped passage formed therein including a first bore 124 aligned to receive fluid from inlet port 42, a second bore 126 providing communication between first bore 124 and inlet valve chamber 122*a*, and a third bore 128 providing communication between first bore 124 and inlet valve chamber 122*b*. First inlet valve 118 is retained in inlet valve chamber 122*a* for pivotal movement between a first position and a second position. In its first position, first inlet valve 118 engages an end surface 130 of valve stop 108 and covers the outlet of second bore 126 for preventing the flow of fluid between inlet port 42 and inlet valve chamber 122*a*. In contrast, movement of first inlet valve 118 to its second position uncovers the outlet of second bore 126 to permit fluid to flow from inlet port 42 into inlet valve chamber 122*a*. In a similar manner, second inlet valve 120 is retained in inlet valve chamber 122*b* for pivotal movement between a first position and a second position. In its first position, second inlet valve 120 engages an end surface 132 of valve stop 108 and covers the outlet of third bore 128 for preventing the flow of fluid between inlet port 42 and inlet valve chamber 122*b*. In its second position, second inlet valve 120 is displaced from end surface 132 of valve stop 108 for permitting fluid to flow from inlet port 42 into inlet valve chamber 122*b*. As will be detailed, pivotal movement of inlet valves 118 and 120 is controlled in response to the pressure differential applied thereon between the fluid pressure in inlet port 42 and the fluid pressure in corresponding inlet valve chambers 122*a* and 122*b*.

Figure 5:
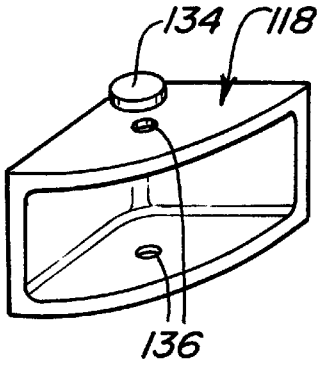
FIG. 5 is a perspective view of one of the inlet valve members associated with the inlet valve assembly.

An enlarged view of first inlet valve 118 is shown in FIG. 5 and which is likewise applicable for defining the structure of second inlet valve 120. In particular, first inlet valve 118 is a generally triangular component having posts 134 (one shown) formed to extend outwardly from each of its front and rear surfaces. Posts 134 are retained in a set of aligned blind bores formed in inlet valve chamber 122*a* and front cover plate 20 to support first inlet valve 118 for pivotal movement between its first and second positions. Additionally, optional bleed ports 136 are formed through the front and rear surfaces of inlet valve 118 to relieve air or fluid trapped therein.

Figure 7:
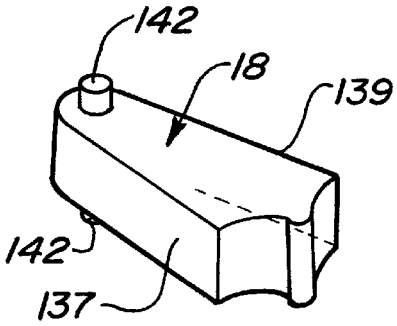
FIG. 7 is a perspective view of the outlet valve.

Outlet valve 18 is retained in outlet chamber 94 for pivotal movement between a first position and a second position. In its first position, a lateral side surface 137 of outlet valve 18 engages an edge surface 138 of outlet chamber 94 for covering aperture 114 and preventing fluid flow between outlet chamber 94 and slot 112*a*. Moreover, lateral side surface 139 of outlet valve 18 is displaced from an edge surface 140 of outlet chamber 94 for permitting fluid communication between slot 112*b* and outlet chamber 94 via aperture 116. In its second position, side surface 139 of outlet valve 18 engages edge surface 140 of outlet chamber 94 for covering aperture 116 and preventing fluid flow between outlet chamber 94 and slot 112*b* while side surface 137 of outlet valve 18 is displaced from edge surface 138 of outlet chamber 94 for permitting fluid communication between slot 112*a* and outlet chamber 94 via aperture 114. Again, movement of outlet valve 18 is controlled in response to the pressure differential exerted thereon between the fluid pressure in slots 112*a* and 112*b*. As best seen from FIGS. 1 and 7, outlet valve 18 has a pair of posts 142 extending outwardly from each of its front and rear surfaces which are retained in blind-bores 144 and 146 formed respectively in outlet chamber 94 and rear cover plate 22.

In operation, the direction of rotation of shaft 28 generates the pressure differentials applied on the various movable valve members for establishing a communication pathway between inlet port 42 and outlet port 44. In particular, rotation of shaft 28 in a first (i.e., clockwise in FIG. 3) direction causes concurrent rotation of pump ring 34 which, as previously noted, causes eccentric relative rotation of stator ring 54 for generating a fluid pumping action therebetween. Initiation of this pumping action causes fluid to be drawn from the sump area through inlet tube 40 and inlet port 42 into the T-shaped passage in valve stop 108. This fluid causes first inlet valve 118 to move to its second position for supplying fluid from second bore 126 to valve inlet chamber 122*a* which, in turn, supplies fluid through aperture 98 into a first side (i.e., the left side in FIG. 3) of pump chamber 56 and into slot 92*a*. Continued rotation of gerotor assembly 14 in the first direction causes fluid entrapped in the pressure chambers between pump ring 34 and stator ring 56 to be transferred to a second side (i.e., the right side) of pump chamber 56 and into slot 92*b* which deliver the higher pressure fluid through aperture 100 into inlet valve chamber 122*b* whereat the higher fluid pressure causes second inlet valve 120 to move to its first position. With second inlet valve 120 held in its first position, fluid is prevented from flowing from inlet valve chamber 122*b* through bores 128 and 126 into inlet valve chamber 122*a*, thereby preventing recirculatory flow (i.e., "short-circuiting") through gerotor pump 10.

With second inlet valve 120 held in its first position, the continuous supply of fluid generated by gerotor assembly 14 due to rotation of shaft 28 in the first direction causes an increase in the fluid pressure within slots 92*b* and 112*b* and which is delivered through aperture 116 into outlet chamber 94. Since the pressure in slot 112*b* is greater than that within slot 112*a*, outlet valve 18 is forcibly urged to its first position such that the higher pressure fluid in slot 112*b* is supplied to discharge chamber 46 through aperture 116, outlet chamber 94 and outlet port 44. Since outlet valve 18 is held in its first position, it also eliminates the establishment of a short circuit path between the fluid in slots 92*a* and 112*a* and discharge chamber 94.

When shaft 28 is rotated in a second (i.e., counterclockwise) direction, a reverse communication pathway is established between inlet port 42 and outlet port 44. In particular, concurrent rotation of pump ring 34 with shaft 28 in the second direction again causes a pumping action in cooperation with stator ring 56. Initiation of this pumping action causes fluid to be drawn from the sump area through inlet tube 40 and inlet port 42 into the T-shaped aperture of valve stop 108. This causes second inlet valve 120 to move to its second position for supplying fluid from third bore 128 to inlet valve chamber 122*b* which, in turn, supplies fluid through aperture 100 into a first side (i.e., the right side) of pump chamber 56 and into slot 92*b*. Continued rotation of gerotor assembly 14 transfers fluid entrapped in the pressure chambers between pump ring 34 and stator ring 56 into a second side (i.e., the left side) of pump chamber 56 and into slot 92*a* which then deliver the higher pressure fluid through aperture 98 into inlet valve chamber 122*a* whereat the fluid pressure moves first inlet valve 118 to its first position. With first inlet valve 118 held in its first position, fluid is prevented from flowing from inlet valve chamber 122*a* through bores 126 and 128 into inlet valve chamber 122*b*, thereby preventing short-circulating of pump 10.

With first inlet valve 118 in its first position, the continuous supply of fluid from gerotor assembly 14 caused by rotation of shaft 28 in the second direction results in an increase in the fluid pressure within slots 92*a* and 112*a* which is delivered through aperture 114 into outlet chamber 94. Since the pressure in slot 112*a* is greater than that in slot 112*b*, outlet valve 18 is forcibly urged to its second position such that the high pressure fluid in slot 112*a* is supplied to discharge chamber 46 through aperture 114, outlet chamber 94 and outlet port 44. Again, location of outlet valve 18 in its second position eliminates a short-circuit fluid path between slots 92*b* and 112*b* and outlet chamber 94.

In addition to varying the size of the pumping components, the capacity of gerotor pump 10 can be tuned to meet various pump output requirements by varying, for example, the physical size of slots 92*a* and 92*b*, slots 112*a* and 112*b*, apertures 98, 100, 114 and 116 and/or the number of lobes 74 and 84. In addition, the pumping capacity can be made to be different for each direction of gerotor rotation by varying the physical size of the slots and/or apertures on one side of pump housing 12 relative to the other.

Figure 8:
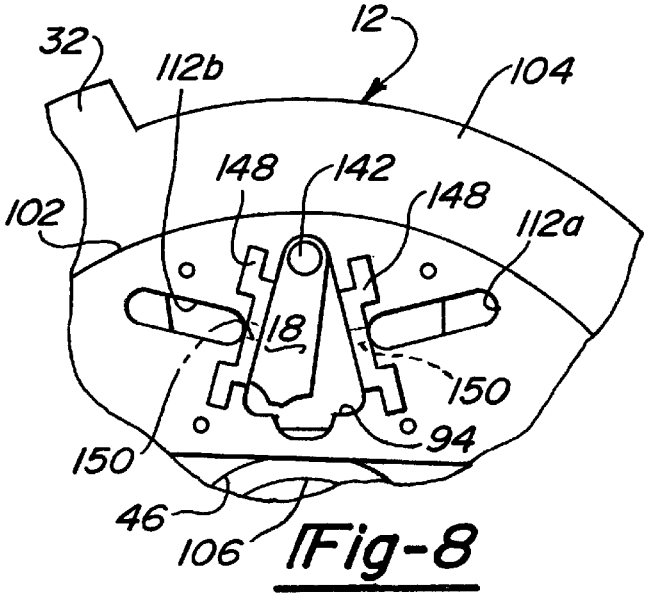
FIG. 8 is a partial rear view of a modified pump housing having valve stops installed therein in addition to the outlet valve.
Figure 9:
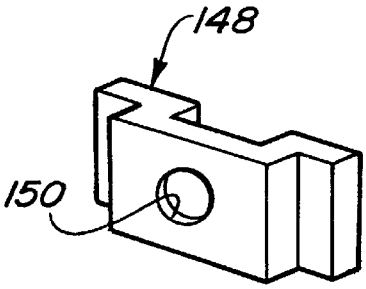
FIG. 9 is a perspective view of the valve stop shown in FIG. 8.

Referring to FIGS. 8 and 9, an alternative optional construction for the outlet valving of gerotor pump 10 is shown.

In particular, a valve stop 148 is retained in each of a pair of corresponding slots which extend from recessed surface 110 of pump housing 12. Valve stops 148 have an aperture 150 which are adapted to provide communication between slots 112*a* and 112*b* and outlet chamber 94. As shown, outlet valve 18 is still movable between its first and second positions for controlling flow into and out of outlet chamber 94 through apertures 150 in valve stops 148. Apertures 150 can be sized differently than apertures 114 and 116, or differently in each valve stop 148, to provide a means for alternating the pump characteristics.

Figure 10:
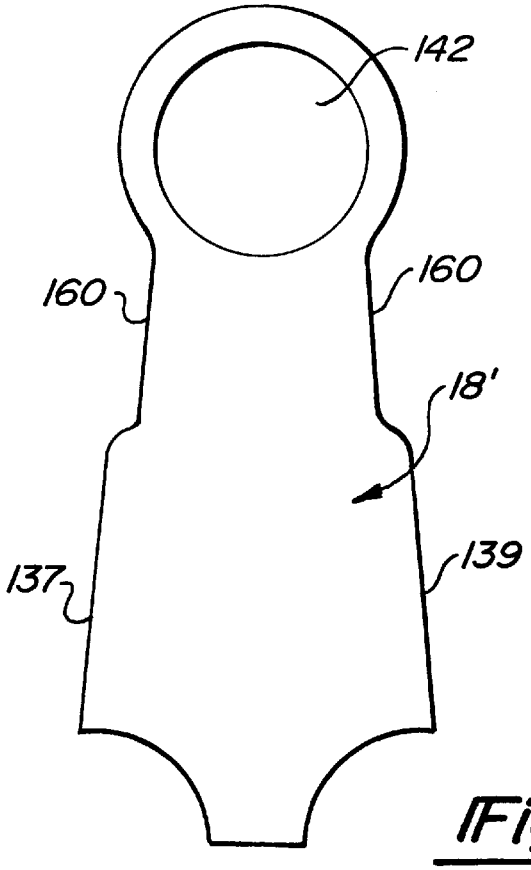
FIG. 10 is a plan view of a modified outlet valve.

Referring now to FIG. 10, a modified outlet valve 18' is shown which can be directly substituted for outlet valve 18. In particular, outlet valve 18' is identical to outlet valve 18 with the exception that it includes a recessed channel 160 formed in its opposite lateral side surfaces 137 and 139. Channels 160 provide a relief area for inhibiting the occurrence of a pressure lock condition, thereby permitting movement of outlet valve 18' between its first and second positions.

Figure 11:
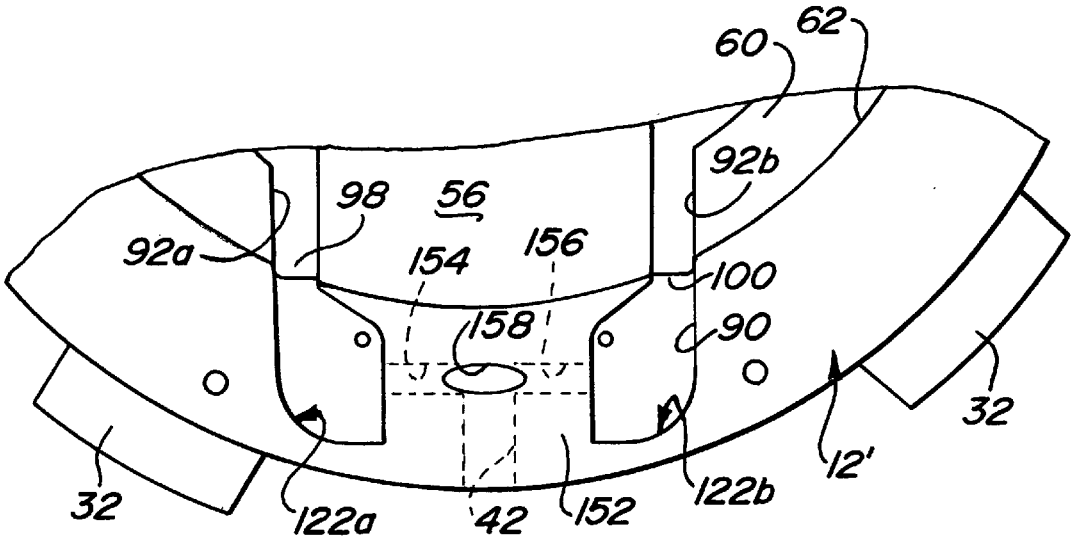
FIG. 11 is a partial front view of another modified pump housing equipped with an inlet valve assembly.

Finally, FIG. 11 illustrates a modified inlet valving arrangement wherein valve stop 108 has been incorporated as an integral portion of pump housing 12'. In particular, a lug segment 152 separates inlet valve chambers 122*a* and 122*b*. Lug segment 152 includes a bore 154 communicating with inlet port 42 and valve inlet chamber 122*a*, and a bore 156 communicating with inlet port 42 and valve inlet chamber 122*b*. As before, first inlet valve 118 controls flow between bore 154 and inlet chamber 122*a* while second inlet valve 120 controls flow between bore 152 and inlet chamber 122*b*. A machining aperture 158 is formed through face surface 58 of pump housing 12' for permitting of bores 154 and 156 to be machined into lug segment 156 and which is sealed relative to inlet chambers 122*a* and 122*b* by front cover plate 20.

The foregoing discussion discloses and describes exemplary embodiments of the present invention. One skilled in the art will readily recognize from such discussion, and from the accompanying drawings and claims, that various changes, modifications and variations can be made therein without departing from the true spirit and fair scope of the invention as defined in the following claims.

What is claimed is:

1. A fluid pump comprising:

a pump housing defining a pump inlet adapted to receive fluid from a fluid source and which is in communication with first and second inlet chambers, an outlet chamber in communication with a pump outlet, a first flow path in fluid communication with said first inlet chamber and said outlet chamber, a second flow path in fluid communication with said second inlet chamber and said outlet chamber, and a pump chamber in fluid communication with said first and second flow paths;

a stator ring supported for rotation in said pump chamber and having an aperture defining a series of internal lobes;

a pump ring supported for rotation in said aperture of said stator ring and having an outer peripheral surface defining a series of external lobes;

a first inlet valve retained in said first inlet chamber for movement between a first position preventing fluid communication between said pump inlet and said first inlet chamber and a second position permitting fluid communication therebetween;

a second inlet valve retained in said second inlet chamber for movement between a first position preventing fluid communication between said pump inlet and said second inlet chamber and a second position permitting fluid communication therebetween; and an outlet valve retained in said outlet chamber for movement between a first position and a second position, said outlet valve operable in its first position to inhibit fluid communication between said first flow path and said pump outlet while permitting fluid communication between said second flow path and said pump outlet, and said outlet valve is operable in its second position to inhibit fluid communication between said second flow path and said pump outlet while permitting fluid communication between said first flow path and said pump outlet;

wherein rotation of said pump ring in a first direction relative to said pump housing generates a pumping action between said pump ring and said stator ring for drawing fluid into said pump inlet and causing said first inlet valve to move to its second position, said second inlet valve to move to its first position, and said outlet valve to move to its first position, and wherein rotation of said pump ring in a second direction relative to said pump housing generates a pumping action between said pump ring and said stator ring for drawing fluid into said pump inlet and causing said second inlet valve to move its second position, said first inlet valve to move its first position, and said outlet valve to move to its second position.

2. The fluid pump of claim 1 wherein rotation of said pump ring in said first direction causes fluid in said pump inlet to forcibly move said first inlet valve to its second position to permit fluid to flow into said first inlet chamber, said first flow path, and a pressure chamber defined between said lobes of said stator ring and said pump ring, said fluid in said pressure chamber flows into said second flow path and into said second inlet chamber for forcibly moving said second inlet valve to its first position, whereby the increased fluid pressure in said second flow path causes said outlet valve to move to its first position for preventing flow of fluid into said first flow path and permitting fluid to be discharged from said outlet chamber through said pump outlet.

3. The fluid pump of claim 2 wherein rotation of said pump ring in said second direction causes fluid in said pump inlet to forcibly move said second inlet valve to its second position to permit fluid to flow into said second inlet chamber, said second flow path, and said pressure chamber, said fluid in said pressure chamber flows into said first flow path and into said first inlet chamber for forcibly moving said first inlet valve to its first position, whereby the increased fluid pressure in said first flow path causes said outlet valve to move to its second position for preventing flow of fluid into said second flow path and permitting fluid to be discharged from said outlet chamber through said pump outlet.

4. The fluid pump of claim 1 wherein a rotational axis of said stator ring is offset relative to a rotational axis of said pump ring to generate said pumping action due to relative rotation between said stator ring and said pump ring in response to driven rotation of said pump ring relative to said pump housing.

5. The fluid pump of claim 1 wherein said first flow path includes a first slot having a first end in communication with said first inlet chamber and a second end in communication with said outlet chamber, and wherein said second flow path includes a second slot having a first end in communication with said second inlet chamber and a second end in communication with said outlet chamber.

6. The fluid pump of claim 5 wherein said first and second slots are symmetrical.

7. The fluid pump of claim 1 further comprising a front cover plate mounted to said pump housing for enclosing said first and second inlet chambers and said pump chamber.

8. The fluid pump of claim 7 further comprising a rear cover plate mounted to said pump housing for enclosing said outlet chamber.

9. A power transfer unit comprising:

a case defining a sump having a supply of fluid retained therein;

a shaft supported from said case for rotation and having a supply passage formed therein; and a fluid pump including a pump housing fixed to said case and defining an inlet receiving fluid from said sump, first and second inlet chambers in fluid communication with said inlet, an outlet in fluid communication with said supply passage, an outlet chamber in fluid communication with said outlet, a first flow path in fluid communication with said first inlet chamber and said outlet chamber, a second flow path in fluid communication with said second inlet chamber and said outlet chamber, and a pump chamber communicating with said first and second flow paths, a stator ring supported for rotation in said pump chamber and having an aperture defining a series of internal lobes, a pump ring fixed to said shaft and supported for rotation in said aperture of said stator ring, said pump ring having an outer peripheral surface defining a series of external lobes, a first inlet valve retained in said first inlet chamber for movement between a first position preventing fluid communication between said inlet and said first inlet chamber and a second position permitting fluid communication therebetween, a second inlet valve retained in said second inlet chamber for movement between a first position preventing fluid communication between said inlet and said second inlet chamber and a second position permitting fluid communication therebetween, and an outlet valve retained in said outlet chamber for movement between a first position and a second position, said outlet valve operable in its first position to inhibit fluid communication between said first path and said outlet chamber while permitting fluid communication between said second path and said outlet chamber, and said outlet valve is operable in its second position to inhibit fluid communication between said second path and said outlet chamber while permitting fluid communication between said first path and said outlet chamber;

wherein rotation of said shaft in a first direction relative to said case causes a pumping action between said pump ring and said stator ring which draws fluid into said inlet and causes said first inlet valve to move to its second position, said second inlet valve to move to its first position and said outlet valve to move to its first position for permitting fluid to flow to said supply passage, and wherein rotation of said shaft in a second direction relative to said case causes a pumping action between said pump ring and said stator ring which draws fluid into said inlet and causes said second inlet valve to move to its second position, said first inlet valve to move its first position and said outlet valve to move to its second position for permitting fluid to flow to said supply passage.

10. The power transfer unit of claim 9 wherein rotation of said pump ring in said first direction causes fluid in said inlet to forcibly move said first inlet valve to its second position to permit fluid to flow into said first inlet chamber, said first flow path, and a pressure chamber defined between said lobes of said stator ring and said pump ring, said fluid in said pressure chamber flows into said second flow path and into said second inlet chamber for forcibly moving said second inlet valve to its first position, whereby the increased fluid pressure in said second flow path causes said outlet valve to move to its first position for permitting fluid to be discharged from said outlet chamber through said outlet to said supply passage.

11. The power transfer unit of claim 9 wherein rotation of said pump ring in said second direction causes fluid in said inlet to forcibly move said second inlet valve to its second position to permit fluid to flow into said second inlet chamber, said second flow path, and said pressure chamber, said fluid in said pressure chamber flows into said first flow path and into said first inlet chamber for forcibly moving said first inlet valve to its first position, whereby the increased fluid pressure in said first flow path causes said outlet valve to move to its second position for permitting fluid to be discharged from said outlet chamber through said outlet to said supply passage.

12. The power transfer unit of claim 9 wherein a rotational axis of said stator ring is offset relative to a rotational axis of said pump ring to generate said pumping action due to relative rotation between said stator ring and said pump ring in response to driven rotation of said shaft relative to said case.

13. The power transfer unit of claim 9 wherein said first flow path includes a first slot having a first end in fluid communication with said first inlet chamber and a second end in fluid communication with said outlet chamber, and wherein said second flow path includes a second slot having a first end in fluid communication with said second inlet chamber and a second end in fluid communication with said outlet chamber.

14. The power transfer unit of claim 13 wherein said first and second slots are symmetrical.

15. The power transfer unit of claim 9 further comprising a front cover plate mounted to said pump housing for enclosing said first and second inlet chambers and said pump chamber.

16. The power transfer unit of claim 15 further comprising a rear cover plate mounted to said pump housing for enclosing said outlet chamber.

* * * * *